United States Patent [19]

Coffel

[11] 4,433,818

[45] Feb. 28, 1984

[54] BEACON-RECEIVER FOR COMMAND GUIDED MISSILES

[75] Inventor: Jerome F. Coffel, New Hope, Minn.

[73] Assignee: Honeywell Inc., Minneapolis, Minn.

[21] Appl. No.: 344,119

[22] Filed: Jan. 29, 1982

[51] Int. Cl.[3] ..... F41G 7/26

[52] U.S. Cl. ..... 244/3.13

[58] Field of Search ..... 244/3.13

[56] References Cited

U.S. PATENT DOCUMENTS 4,234,141 11/1980 Miller, Jr. et al. ..... 244/3.13

FOREIGN PATENT DOCUMENTS 2539626 3/1976 Fed. Rep. of Germany ..... 244/3.13

*Primary Examiner*—Charles T. Jordan

*Attorney, Agent, or Firm*—George W. Field

[57] ABSTRACT

Apparatus for use with a command-guided missile including: a beacon-receiver unit comprising a member having a patterned surface including a first area, which is retroreflective, and a second area, which is not retroreflective; apparatus causing rotation of the member about a spin axis passing through the surface; and focusing apparatus spaced on the member and having an optical axis passing through the surface, so that electromagnetic radiation reaching the focusing apparatus at an angle oblique to the optical axis is focused on the surface as an image which defines on the areas, as the member rotates, a closed curve about the spin axis, a characteristic of the closed curve varying with the oblique angle.

11 Claims, 2 Drawing Figures

BEACON-RECEIVER FOR COMMAND GUIDED MISSILES

TECHNICAL FIELD

This invention relates to the field of guidance and control, and specifically to a beacon-receiver unit for use with command guided missiles.

BACKGROUND OF THE INVENTION

Command guided missiles are fired singly or in salvos from a vehicle having a scanned laser transmitter-receiver, and are intended to be controlled in flight direction by signals on the laser beam. In order to do this the control apparatus in the launcher vehicle must receive data on the location of the missile, its direction of motion relative to the beam, and the relation of the missile's roll axis with respect to the horizontal. When missiles have fired in a salvo, it is also necessary to identify the separate missiles in the scanner view.

BRIEF SUMMARY OF THE INVENTION

A beacon-receiver unit according to the invention retroreflects energy from the observing scanner in a manner which not only locates the unit with respect to the scanner, but also indicates the orientation of the unit in space, to enable control of its movement. The unit is also arranged to identify itself among a salvo of such units, and to receive signals for its guidance or fusing.

Various advantages and features of novelty which characterize the invention are pointed out with particularlity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described the preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
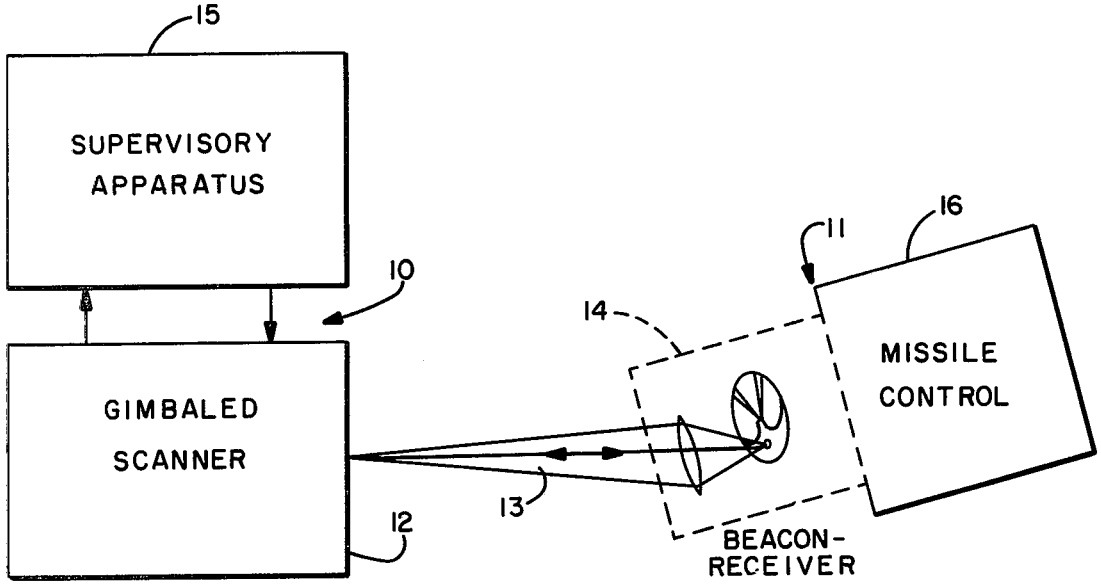
FIG. 1 is a schematic showing of a system including a beacon-receiver unit according to the invention.

In general terms, a system according to the invention comprises a launcher 10 and one or more missiles 11, the movement of which is to be controlled from the launcher. To accomplish this, a laser scanner 12 at the launcher is gimbaled to emit a beam 13 of electromagnetic radiation toward the missile. A beacon-receiver unit 14 at the missile acts to retroreflect the radiation to the launcher, so that the line of sight angle of the missile from the launcher can be determined, and the emitted radiation may be pulsed or phase detected to enable determination from the retroreflected beam, at the launcher, of the distance to the missile. The beam may also be modulated, by supervisory apparatus 15, with signals for controlling the movement of the missile or performing other functions, and unit 14 accepts these signals for use in a missile control 16. Unit 14 also functions to encode the retroreflective radiation, by pulse duration modulation, with a signal indicative of the angle between the missile axis and the line-of-sight to the launcher, and may also include components to identify the missile, if one of a salvo, and to define the missile's roll angle.

Figure 2:
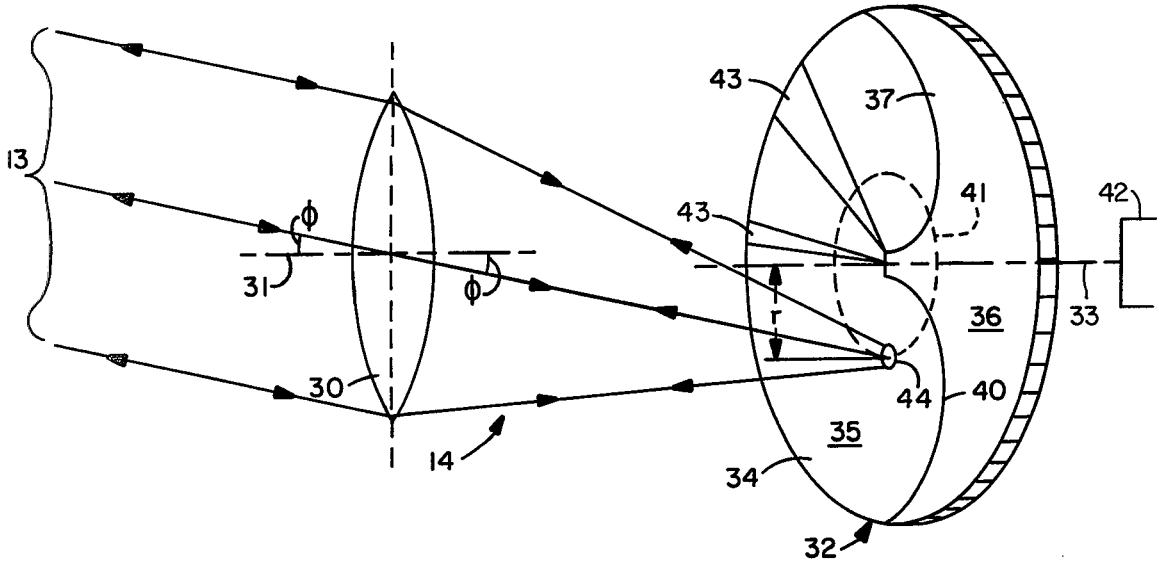
FIG. 2 is a showing of the beacon-receiver unit itself, to a larger scale.

FIG. 2 shows beacon-receiver unit 14 to comprise a lens 30 having an optical axis 31, and a disc or member 32 located in the focal plane of lens 30 and rotatable about a spin axis 33 which is parallel to axis 31 and may be coincident therewith.

Member 32 comprises a surface 34, perpendicular to axis 33, which carries a pattern comprising a first portion 35 which is retroreflective, and a second portion 36 which is not retroreflective but is light sensitive instead. The borders 37 and 40 between portions 35 and 36 are not radial from axis 33, but are configured so that the distance between them, measured along any arc such as arc 41, centered at axis 33, is proportional to the distance of the arc from the axis.

If the missile in which the unit is mounted moves with a component of spin, unit 14 may be fixed in the missile with axis 33 lying along the spin axis of the missile. If the missile does not spin, means such as a motor 42 are provided for causing member 32 to rotate in the missile about axis 33, which is arranged to extend front-to-back of the missile, and hence changes in azimuth and elevation with the heading and pitch of the missile.

A number of areas 43 of portion 35 are made non-retroreflective, to serve as coding interruptions, as will presently be explained: if a member is fixed in the missile, one of these areas may be positioned in alignment with a zero of missile roll angle.

From the foregoing it will be evident that when beam 13 from scanner 12 reaches lens 30 at an angle to axis 31, an image 44 of the source appears on the surface of member 32, at a radius r from axis 33 determined by the angle between axis 31 and the direction of the laser beam, and that as member 32 rotates the image 44 defines on areas 35 and 36 a closed curve about axis 33.

When image 44 falls on retroreflective portion 35, the energy is in general returned along its path of incidence, to scanner 12: when the image falls on portion 36, energy is not returned to the scanner. It follows therefore that the portion of each rotation of member 32 during which retroreflection takes place is a measure of the radius of the arc 41 traced by the image, and hence of the angle between axis 33 and the axis of the beam. When the angle is small, radius r is also small and the image is on surface 35 for a large portion of the rotation of member 32, resulting in a longer period of retroreflection to be received at scanner 12. When the angle is large, radius r is also large, and the image is on surface 35 for a smaller portion of the rotation of member 32, resulting in a smaller period of retroreflection to be received at scanner 12.

The pattern on the surface of member 32 is such that retroreflection takes place during no less than half the period of rotation of the member. While the image is on portion 36 of the member, the signals impressed on the beam affect the light sensitive surface, and result in electrical signals which may be conducted to missile control unit 16 for appropriate use in controlling the direction of movement of the missile, or performing fusing or other functions.

Areas 43 function to cause brief coding interruptions in the retroreflected energy, which can be interpreted at the launcher as identification of which of plural missiles is being observed. If coordinated with missile roll, on installation, the occurrence of a specific interruption may indicate by its timing the attitude of the missile about its roll axis.

The operation of the invention will now be apparent. A beacon-receiver unit is installed in each missile to be launched: if appropriate the units are provided with coding areas differently positioned to identify particular missiles in a salvo, and individual members may be coordinated during installation with the intended roll angle zeros of the missiles.

Now, when a missile is launched scanner 12 in the launching vehicle is directed at the missile in flight. The image of the scanner source is focused by lens 30 to impinge on rotation member 32 of the particular missile. While the image is falling on a surface 35, the energy is retroreflected, along its same path, to scanner 12, which accordingly supplies a signal to supervisory apparatus 15 for a period determined by the value of the angle for the particular missile. If that angle is to be changed, apparatus 15 modulates the beam from scanner 12 with signals which, when the scanner image falls on portion 36 of member 32 in the missile, are supplied to control 16 to perform the desired functions in the missile.

If a salvo of differing missiles has been launched, the coding interruptions of each retroreflective signal identify which missile is being observed, when knowledge of the identity of particular missiles is important to the success of the overall mission.

Various advantages and features of novelty which characterize the invention are pointed out with particularity in the claims annexed hereto and forming a part hereof. However, for a better understanding of the invention, its advantages, and objects attained by its use, reference should be had to the drawing which forms a part hereof, and the accompanying descriptive matter, in which there is illustrated and described a preferred embodiment of the invention.

The embodiments of the invention in which an exclusive property or right is claimed are defined as follows:

1. A beacon-receiver comprising, in combination:

a member having a patterned surface including a first area which is retroreflective and a second area which is not retroreflective;

means causing rotation of said member about a spin axis passing through said surface;

and focusing means spaced from said member and having an optical axis passing through said surface, so that electromagnetic radiation reaching said focusing means at an oblique angle to said optical axis is focused on said surface as an image which defines on said areas, as said member rotates, a closed curve about said spin axis, a characteristic of said closed curve varying with said oblique angle.

2. A beacon-receiver according to claim 1 in which the first area includes coding interruptions, traversed by said closed curve, which are not retroreflective.

3. A beacon-receiver according to claim 1 in which said surface is coincident with the image plane of said focusing means.

4. A beacon-receiver according to claim 1 in which said closed curve is a circle and the pattern of said surface is such that the portion of each said rotation during which said circle impinges on said first area, and said radiation is retroreflected through said focusing means, is a measure of said oblique angle.

5. In combination:

a beacon-receiver according to claim 4 in which the rotation of said member has a known period;

means remote from said beacon-receiver for projecting electromagnetic radiation to said surface through said focusing means;

and means remote from said beacon-receiver for receiving radiation retroreflected from said surface through said focusing means and computing the relation between the duration of the retroreflection of radiation during each period, and the length of said period, as a measure of said oblique angle.

6. A beacon-receiver according to claim 1 in which said second area is radiation sensitive, and control means connected to said radiation sensitive area for actuation by signals therefrom occuring while said image impinges thereon.

7. In combination:

a beacon-receiver according to claim 6;

and means remote from said beacon-receiver for projecting electromagnetic radiation thereto, said radiation being modulated to actuate said control means when said radiation impinges on said second area.

8. Apparatus for remotely determining the magnitude of the angular disorientation of a body with respect to the axis of a beam of electromagnetic radiation falling thereon, comprising, in combination:

means at a site remote from the body for projecting a beam of electromagnetic radiation along an axis toward the body;

a member carried by the body for receiving and retroreflecting said beam, said member having a patterned surface including a first area which is retroreflective, and a second area which is not retroreflective;

means causing rotation of said member about a spin axis passing through said surface;

focusing means carried by the body at a site spaced from said member and having an optical axis passing through said surface, so that radiation from said beam reaching said focusing means at an oblique angle to said optical axis is focused on said surface as an image which defines on said areas, as said member rotates, a closed curve about said spin axis and is retroreflected through said focusing means in the portion of each rotation of said member during which said image falls on said first area;

and means for receiving the radiation retroreflected through said focusing means and determining the relation of said portion of the total period of rotation of said member, as a measure of said oblique angle.

9. Apparatus according to claim 8 in which said optical axis substantially coincides with said spin axis, so that said closed curve is a circle the radius of which varies with said oblique angle, and in which said pattern is such that the length of said portion varies with the radius of said circle.

10. A beacon-receiver comprising, in combination:

a member having a patterned surface including a first area which is retroreflective and a second area which is not retroreflective;

means causing cyclical movement of said member with respect to an axis;

and focusing means spaced from said member and having an optical axis passing through said surface, so that electromagnetic radiation reaching said focusing means at an oblique angle to said optical axis is focused on said surface as an image which defines a predetermined path on said areas as said member moves, a characteristic of said path varying with said angle.

11. A beacon-receiver according to claim 10 in which said surface is coincident with an image surface of said focusing means.

* * * * *